United States Patent [19]

Luiten et al.

[11] 4,086,050

[45] Apr. 25, 1978

[54] METHOD AND APPARATUS FOR GAS CIRCULATION IN A HEAT TREATING FURNACE

[75] Inventors: Cornelis Hendricus Luiten; Ferdinand Limque, both of Nijmegen, Netherlands

[73] Assignee: Ipsen Industries International, Kleve, Germany

[21] Appl. No.: 646,502

[22] Filed: Jan. 5, 1976

[30] Foreign Application Priority Data

Jan. 15, 1975 Germany ..... 2501360

[51] Int. Cl.[2] ..... F27D 7/00

[52] U.S. Cl. ..... 432/25; 34/92; 432/205

[58] Field of Search ..... 432/18, 23, 25, 205, 432/209, 18 R; 34/92

[56] References Cited

U.S. PATENT DOCUMENTS

| | | | |
|---|---|---|---|
| 1,949,716 | 3/1934 | Harsch | 432/18 |
| 2,091,172 | 8/1937 | Wilson | 432/209 |
| 2,589,811 | 3/1952 | Holcroft | 432/209 |
| 2,800,317 | 7/1957 | Ipsen | 432/209 |
| 2,839,285 | 6/1958 | Vickers | 432/209 |
| 3,399,875 | 9/1968 | Ipsen | 432/205 |
| 3,517,916 | 6/1970 | Ross et al. | 432/209 |
| 3,837,794 | 9/1974 | Phillips | 432/18 |
| 3,850,574 | 11/1974 | Namba | 432/205 |

*Primary Examiner*—John J. Camby
*Attorney, Agent, or Firm*—DeLio and Montgomery

[57] ABSTRACT

The method for gas circulation in a furnace, such as a vacuum furnace, for the heat treatment of work pieces wherein the gas is caused to circulate with turbulence while avoiding a set or stable flow pattern and the vacuum furnace adapted to carry out this method by means of fans so located and operated as to circulate the gas with turbulence and vorticity.

11 Claims, 2 Drawing Figures

METHOD AND APPARATUS FOR GAS CIRCULATION IN A HEAT TREATING FURNACE

Figure 2:
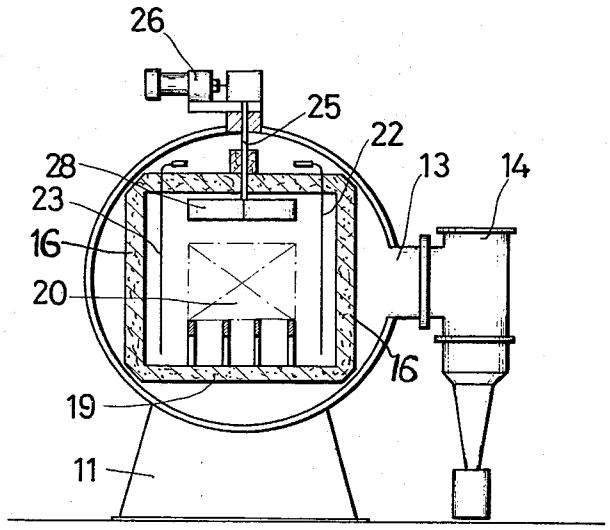

The invention relates to a method for gas circulation in a furnace operated at low pressure, in particular in vacuum, for the heat treatment of work pieces, and to a vacuum furnace for the execution of this method, which furnace is equipped with a heating chamber in which a fan is disposed for gas circulation.

Furnaces for the heat treatment of work pieces in a gas atmosphere or in vacuum are known, where there is disposed, in the heating chamber, a fan which, in conjunction with baffles disposed around the charge, takes care of a forced circulation of the furnaces atmosphere inside the heating chamber. The force circulation or stable gas circulation of the furnace atmosphere in a heated furnace chamber is supposed to lead to a uniform impingement of a charge. For this purpose, the gas flow through the charge is oriented and intensified in a known atmosphere-vacuum furnace by means of the guide plates and baffles. It is possible at the same time to assist the heat transfer in the charge by convection.

It is a disadvantage of this method of forced circulation of a gas atmosphere in a furnace and of the fan and baffle equipped furnace itself that a uniform impingement of a charge cannot be achieved if the furnace is operated at low pressure, in particular in vacuum. For example, irregularities in the carburization results are found when vacuum-carburizing steel parts by subjecting them in a vacuum furnace to a carburizing atmosphere under heat. It was found specifically that, with a stable gas circulation, there appeared local "cloud formation" which, during the carburization process, lead to the surface of the work pieces not having the desired carbon content in places.

It is an object of the invention to ensure a uniform impingement of a charge of work pieces to be heat treated, particularly in heat treating furnaces operated in the high vacuum range, and to prevent local "cloud formations".

According to the invention, the problem is solved in that a method for gas circulation in a furnace operated at low pressure, in particular in vacuum, for the heat treatment of work pieces is proposed, in which furnace the gas introduced into the chamber containing the charge is made turbulent while a stable gas circulation is avoided, and the flow pattern and intensity of the gas circulation are varied during the treatment of a charge. Due to the desired vorticity of the gas introduced into the chamber containing the charge and the variation of flow pattern and intensity of the gas circulation during the heat treatment of the charge, a stable gas circulation of the kind known from the state of the art is avoided, and thus a permanent, local "cloud formation" is prevented. Due to the vorticity of the gas, all surface areas of the work pieces are impinged by the gas in the course of the treatment time of a charge, thereby bringing about a uniformity of treatment, i.e. of carburization, not achievable with a stable gas circulation. It is assumed that the difficulties encountered with the stable gas circulation are attributable to the low gas density and the higher kinematic toughness when working with low vacuum pressure. The weaker eddy effects caused thereby and leading to a pronounced clouding are compensated for by the proposal of the invention, which expresses itself, for instance during the carburization of work pieces at low pressure, in an excellently uniform carburization. The furnace according to the invention operates preferably in the pressure range from 20 to 500 Torr.

It is expedient to provide for heating by direct heat transfer through radiation in vacuum.

The vacuum furnace for the heat treatment of work pieces as suggested for the solution of the problem posed has a heating chamber in which is disposed a fan for gas circulation, and it is characterized in that a second fan for gas vorticity is coordinated with the first fan, and in that the speed and/or direction of rotation of both fans are variable, preferably independent of each other. By changing the speed and possibly the direction of rotation, the desired turbulences are produced so as to be controllable in a simple manner. Additional eddy effects are attainable, according to one preferred embodiment of the invention, in that the fans are provided with the two blades each, mounted crosswise relative to each other and coordinated so that there remains only a short distance between their radii of rotation.

The fans may suitably be mounted under the heating chamber ceiling. There may also be provided more than two fans. It is advantageous to heat the heating chamber by radiating heating elements.

Figure 1:
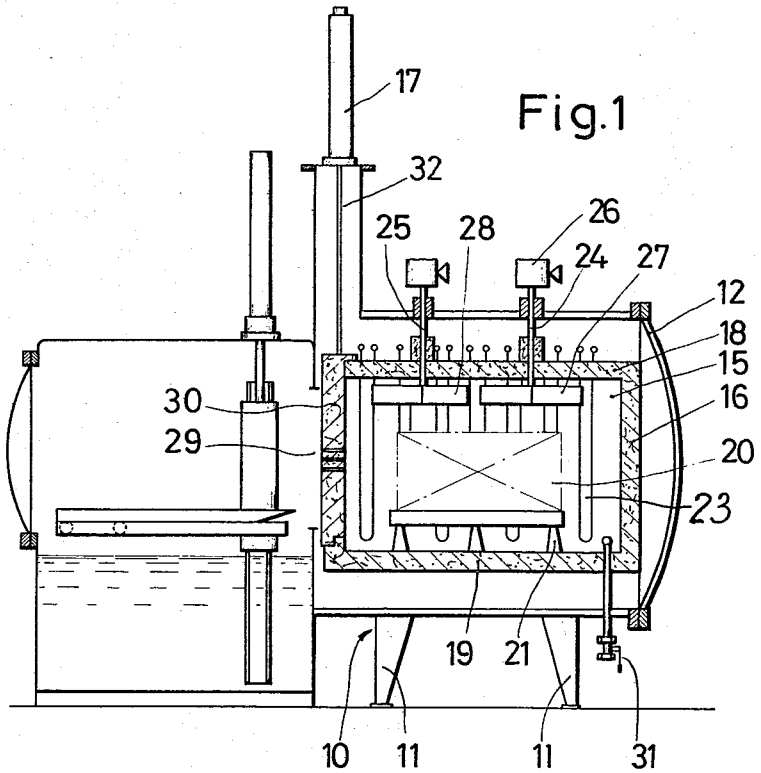

Other details, characteristics and advantages of the subject of the invention follow from the specification below referring to the accompanying drawing which illustrates, as an embodiment example, a vacuum furnace according to the invention. In the drawing, FIG. 1 is a vacuum furnace in schematic, side elevation, parts being in section, and FIG. 2 is the vacuum furnace in transverse cross section.

A vacuumtight container 12 is mounted on a supporting frame 10 with two legs 11. The container 12 is of cylindrical shape, and one side of it is provided with a connecting nipple 13 for connection to a vacuum pump system via a vacuum line 14. The two end faces of container 12 are closed, a charge opening 29 being provided in the left face in FIG. 1 of the drawing.

Formed in the interior of container 12 is heating chamber 15 which also forms the charge chamber of the furnace in which the heat treatment of work pieces takes place. The heating chamber 15 consists of three side walls 16, a bottom 19 and a ceiling 18 of heat resistant, heat insulating material. The fourth side wall is formed by a raisable and lowerable door 30. For this purpose, the door 30 is movable into a container extension 32 by means of lifting device 17 to open the heating chamber 15. When the door 30 is open, the heating chamber 15 can be loaded with a charge 20. A supporting device 21 permitting the entry of gases also to the underside of the charge is provided for the retention of charge 20 in the heating chamber 15.

The heating chamber 15 is heated by heating elements 22, 23, a direct heat transfer by radiation from the built-in heating elements to the work pieces in charge 20 taking place. Below ceiling 18 of heating chamber 15 are, in juxaposition, two fans 24, 25, each driven by an electric drive 26 and transmission means. The fans 24, 25 each have a cross type impeller 27, 28 with four blades.

After the charge 20 is placed into the heating chamber 15 by means of the charging device shown, the heating chamber 15 is evacuated and heated to the desired temperature in vacuum by the built-in heating elements 22, 23. After attainment of the operating temperature, the required gas atmosphere is supplied to the heating chamber 15 with controlled pressure through a gas connection 31 and circulated during the treatment of the charge by means of the fans 24, 25 without baffle plates. The speed and direction of rotation of the fans 24 and 25 can be varied independently of each other, it being possible by appropriate control of the equipment to vary the intensity and flow pattern of the circulation of the atmosphere through the charge, such as during a carburization cycle, in such a manner that a uniform impingement of gas on the charge and, thus, a uniform carburization for example, is achieved. The radii of rotation of the impellers 27 and 28 of the fans 24, 25 are located so close to each other that the eddies produced by each blade collide, causing additional eddy effects.

A second chamber of the furnace is also shown at the left of FIG. 1, the structure and function of which forms no part of the present invention.

It will thus be seen that the objects set forth above, among those made apparent from the preceding description, are efficiently attained and, since certain chamges may be made in carrying out the above method in the construction set forth without departing from the spirit and scope of the invention, it is intended that all matter contained in the above description and shown in the accompanying drawings shall be interpreted as illustrative and not in a limiting sense.

What is claimed is:

1. Method for thermo-chemical treatment of work pieces in a furnace operated at pressure, in particular vacuum, characterized by the steps of treating the charge, introducing the treating gas into the vacuum chamber containing the charge, causing the gas to become turbulent while avoiding a stable gas circulation, and varying the flow pattern and intensity of the gas circulation during the treatment of the charge.

2. Method according to claim 1, characterized in that heating is effected by direct heat transfer through radiation in vacuum.

3. A vacuum furnace for the heat treatment of work pieces comprising a heating chamber, means for supporting work pieces in said chamber, means for evacuating said chamber, means for heating said work pieces, means for supplying a gas to said chamber, a plurality of closely spaced fans in said chamber and means coordinating said fans to circulate said gas with increased vorticity.

4. A vacuum furnace according to claim 3 in which includes means for controlling and the varying the speed of rotation of at least one of said fans.

5. A vacuum furnace according to claim 3 in which the coordinating means includes means for controlling and varying the direction of rotation of at least one of said fans.

6. A vacuum furnace according to claim 3 in which the coordinating means includes means for controlling and varying the speed and direction of rotation of at least one of said fans.

7. A vacuum furnace according to claim 3 in which the coordinating means includes means for controlling independently the operation of the respective fans.

8. A vacuum furnace according to claim 3 wherein each fan is provided with two blades disposed crosswise to each other, and the fans are mounted with the radii of rotation of their blades spaced by only a short distance.

9. A vacuum furnace according to claim 3 wherein the fans are mounted adjacent to the upper wall of the heatiing chamber.

10. A vacuum furnace according to claim 3 wherein more than two fans are provided.

11. A vacuum furnace according to claim 3 wherein the heating means comprises radiation heating elements in the heating chamber.

* * * * *

UNITED STATES PATENT AND TRADEMARK OFFICE

CERTIFICATE OF CORRECTION

PATENT NO. : 4,086,050

DATED : April 25, 1978

INVENTOR(S) : Cornelis Hendricus Luiten and Ferdinand Limque

It is certified that error appears in the above-identified patent and that said Letters Patent are hereby corrected as shown below:

Col. 1, 1.33-34, "for-mation" should read --for-mations--;
Col. 2, 1.40, between "is" and "heating" insert --a--;
Col. 2, 1.58, "juxaposition" should read --juxtaposition--;
Col. 3, 1.23, between "method" and "in the" insert --and--;
Col. 3, 1.31, delete "pressure, in particular";
Col. 4, 1.12, after "which" insert --the coordinating means--;
Col. 4, 1.13, after "and" delete "the".

Signed and Sealed this

*Nineteenth* Day of *September 1978*

[SEAL]

*Attest:*

RUTH C. MASON
*Attesting Officer*

DONALD W. BANNER
*Commissioner of Patents and Trademarks*